United States Patent [19]

Bianchi

[11] 4,380,203

[45] Apr. 19, 1983

[54] DEVICES GENERATING SYNCHRONIZING SIGNALS IN SEWING MACHINES

[75] Inventor: Nereo Bianchi, Pavia, Italy

[73] Assignee: NECCHI S.p.A., Pavia, Italy

[21] Appl. No.: 146,126

[22] Filed: May 2, 1980 (Under 37 CFR 1.47)

[30] Foreign Application Priority Data

May 3, 1979 [IT] Italy ..... 42906 A/79

[51] Int. Cl.³ ..... D05B 3/02

[52] U.S. Cl. ..... 112/158 E; 112/275

[58] Field of Search ..... 112/158 E, 275, 277, 112/67, 87

[56] References Cited

U.S. PATENT DOCUMENTS

| | | | |
|---|---|---|---|
| 3,582,739 | 6/1971 | Daab et al. | 112/275 X |
| 3,872,808 | 3/1975 | Wurst | 112/158 E |
| 4,013,933 | 3/1977 | Dohi et al. | 112/275 X |
| 4,103,632 | 8/1978 | Bowles | 112/158 E |
| 4,143,605 | 3/1979 | Soeda et al. | 112/158 E |
| 4,269,132 | 5/1981 | Hsu | 112/275 |

*Primary Examiner*—Peter P. Nerbun

*Attorney, Agent, or Firm*—Hubbell, Cohen, Stiefel & Gross

[57] ABSTRACT

A sewing machine (100) having a needle bar (120,122) and feed means (131,132,602,603) in which actuators (124,130) adjust the transverse position of the needle bar (120,122) and the positional displacement of the feed means (131,132,602,603) in response to control signals provided thereto, and a rotatable main shaft (104,204,205) operatively connected to the needle bar (120,122) for enabling transverse oscillation thereof which shaft (104) is driven by a main motor (201), includes an arrangement for generating synchronizing timing control signals to the actuators (124,130) and a stop control signal to the motor (201) to stop the shaft (104,204,205) in a predetermined arc of rotation in which a common magnet (208,508) mounted in a holder (207,507) for rotation with the shaft (104,204,205) interacts with a pair of spaced apart magnistors (211,213) to provide the timing control signals to the actuators (124,130) and a separate magnet means which may be either a single magnet (509) or a pair of spaced apart magnets (209,210), also mounted in the holder (207,507) interacts with a separate magnistor (212) to provide the stop control signal. The magnistors (211,212,213) are linearly arranged on a printed circuit board (313) forming part of the machine circuitry. A soft iron loop (601) may be provided to surround the area of such interaction so as to close the magnetic path and increase the associated flux density and minimize losses.

41 Claims, 11 Drawing Figures

116
203
204
205
124
125
120
122
118
108
100
114
130
329
214
216
215
345
212
213
209
210
211
208
207
335
202
203
350
349
104
104
131
602
603
132
112

DEVICES GENERATING SYNCHRONIZING SIGNALS IN SEWING MACHINES

TECHNICAL FIELD

The present invention refers to an improvement to devices generating synchronizing signals in sewing machines and more particularly electronic sewing machines.

BACKGROUND ART

It is common knowledge that in sewing machines having an automatic control for the stitch forming instrumentalities, that is for the transverse oscillations of the needle bar and for the longitudinal displacements of the member feeding the fabric whereon the stitch has to be performed, such controls are given through actuators moved in compliance with given synchronism moments. The actuator controlling the transverse oscillation of the needle bar is moved when the needle comes out of the fabric, whereas the actuator controlling the longitudinal displacement of the fabric feed member is moved when the point of the needle penetrates the fabric. The right moment of initial movement of such actuators is determined by synchronizing signals generated by devices surveying the position of the needle. Therefore such devices generally survey the angular position of sewing machine main shaft, and for example provide two movable magnets fixed to the main shaft and two fixed sensors (i.e. Hall effect sensors) generating the two synchronizing signals for the two actuators, such as accomplished in commonly assinged corresponding U.S. patent applications Ser. No. 41,293, filed May 22, 1979, now patent No. 4,275,624 and entitled "Improved microprocessor controlled electronic sewing machine", and U.S. patent application Ser. No. 973,386, filed Dec. 26, 1978 now U.S. Pat. No. 4,280,424 entitled "Household type sewing machine having microprocessor control", the contents of which are hereby incorporated by reference herein in their entirety. Moreover, in order to attain that when the machine stops the needle is out of the fabric, a third pair of sensors fixed and movable is applied, always connected to the sewing machine main shaft.

Object of the present invention is to realize an improvement to the devices generating synchronizing signals in sewing machines, in such a way that the said devices could be realized in a relatively simple and therefore cheap way, and assuring right working.

Other objects and advantages of the present invention will be apparent from the following description.

DISCLOSURE OF THE INVENTION

According to the present invention an improvement is realized to the devices generating synchronizing signals in sewing machines, said sewing machines providing at least two actuator means to control the displacements of corresponding devices in said sewing machines and said devices comprising two magnetic sensor means, such as magnistors, to generate corresponding synchronizing signals of the movement of said actuator means, relative to the periodical movement of the main shaft of said sewing machine, characterized in that the magnetic sensor means are energized by only one means indicating the position of the said element having periodical movement, such as a permanent magnet mounted on the main shaft. A separate magnet means and sensor means are provided for generating a stop control signal to stop the main shaft in a predetermined arc of rotation. This magnet means, which may be a single magnet or a pair of spaced apart magnets, is mounted on the main shaft in a common holder with the other magnet and the three magnetic sensors are linearly arranged on a printed circuit board for interaction with the rotating magnets. A soft iron loop may be provided to surround the area of interaction of the magnets and magnistors to increase the flux density and minimize losses.

BRIEF DESCRIPTION OF DRAWINGS

For a better understanding of the present invention, it will be now described, as a non restrictive example, with reference to the annexed drawings, in which.

BEST MODE FOR CARRYING OUT THE INVENTION

Figure 1:
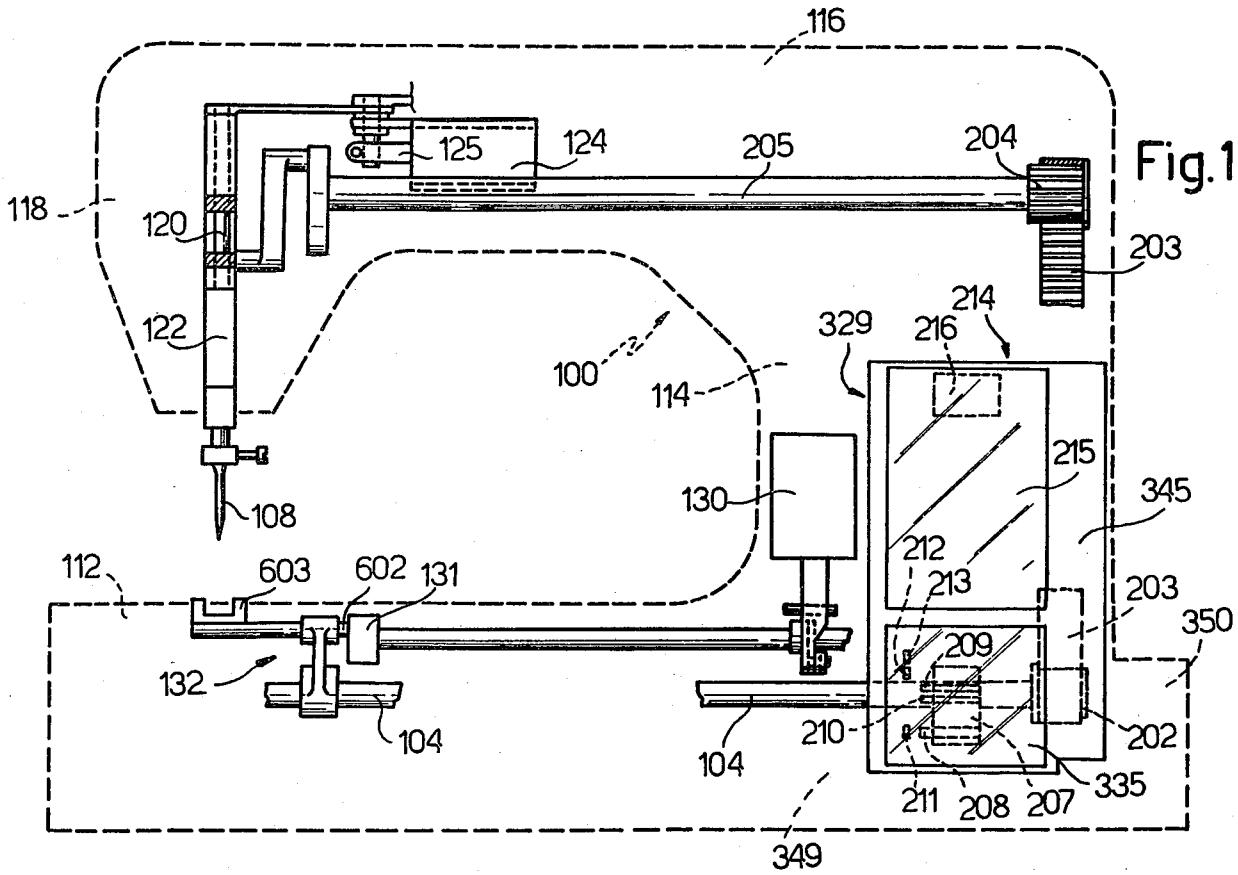
FIG. 1 is a schematical view of a sewing machine with the improvement according to the present invention.

With reference to FIG. 1, a sewing machine, generally represented by the reference numeral 100, is shown. This sewing machine 100 is preferably the type described in the aforementioned commonly assigned copending U.S. patent applications and is an improvement thereon. Sewing machine 100 includes a bed 112, a standard 114 and a horizontal arm 116 overhanging bed 112 and terminating in head 118 comprising a needle bar 120 borne by a needle bar gate 122 which is mounted at the end of arm 116 into head 118, so as to effect transverse displacements in response to controls received from an actuator 124 realized in a known way, for instance via a rotary or linear electromechanical actuator. The kinematic linkage between a connecting rod coming from the actuator 124 and the needle bar gate 122 is not described in detail because it is previously described for instance in the Italian patent application No. 42904A/79 corresponding to commonly owned U.S. patent application Ser. No. 41,293, filed May 22, 1979, entitled "Improved microprocessor controlled electronic sewing machine", whose contents are hereby specifically incorporated by reference herein in their entirety.

In the sewing machine is moreover incorporated another actuator 130 connected, through a kinematic chain not described in detail and for instance shown in the above referred to patent application, to an element 131 substantially of known type, fastened at one end 602 of a known feed adjusting mechanism 132, to adjust the displacement of a known feed dog 603.

Figures 5, 8, 9:
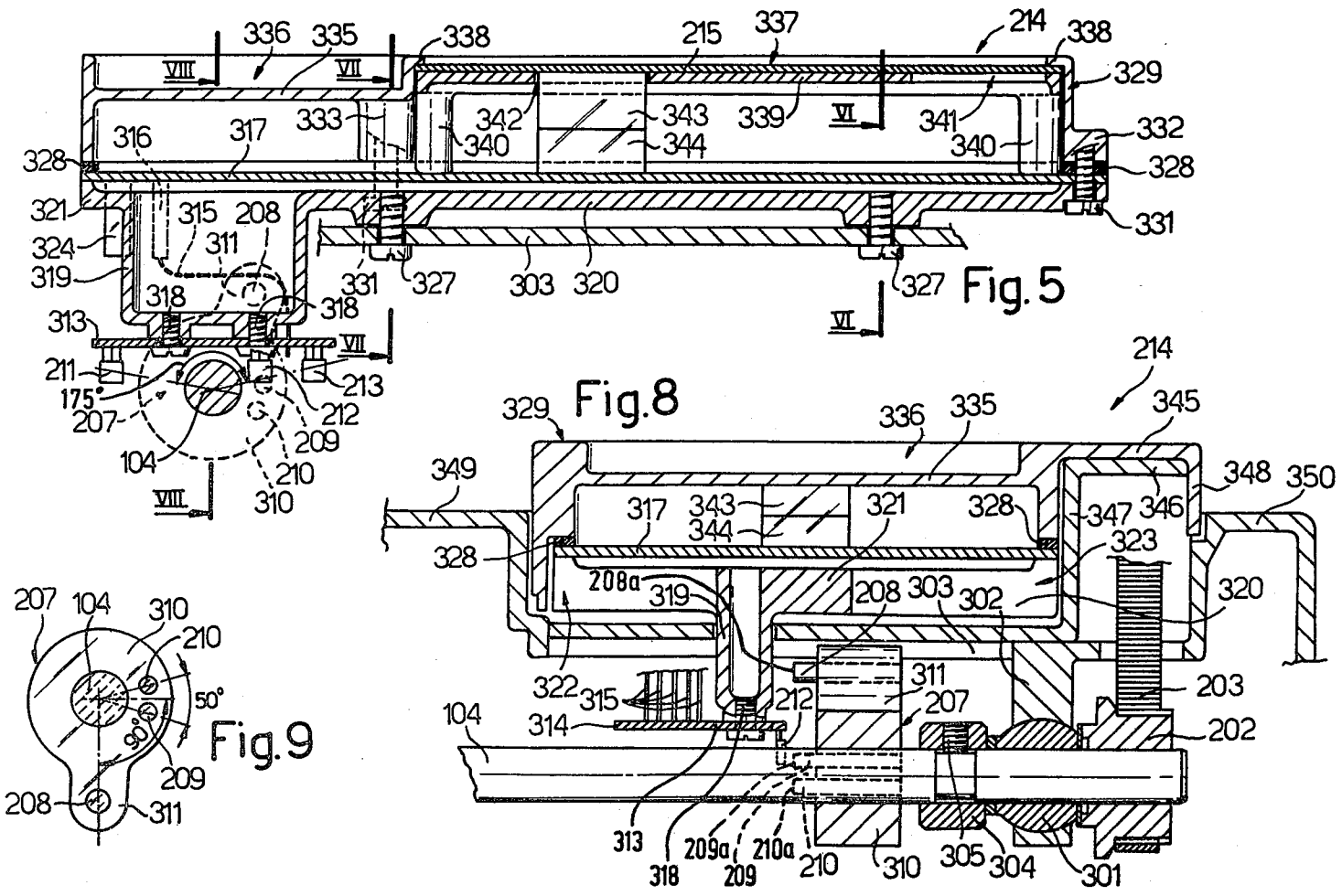
FIG. 5 is a more detailed section view along line V—V of FIG. 4.
FIG. 9 is a front view of an embodiment of the magnet holder element portion of the device generating synchronizing signals comprising the improvement according the present invention.

This sewing machine 100 is provided with a main motor (indicated with numeral 201 in FIG. 2) driving a main shaft 104 which, as better shown in FIG. 8, is mounted at one end through a ball bushing 301 by an arm 302 deriving its origin from a shaped plate 303 inside sewing machine 100. A toothed pulley 202 is fastened at the end of shaft 104 and is axially fixed relative to ball bushing 301, by means of bushing 304 locked by a dowel 305. A toothed belt 203 is engaged on toothed pulley 202 which belt 203 is coupled to another toothed pulley 204 which is fixed at the end of the upper shaft 205 (FIG. 1), to conventionally impart the reciprocating motion to a needle 108 to obtain the conventional sewing on a fabric. Each revolution of shaft 104 corresponds to one stitch with shaft 104 being tied to shaft 205 in a one to one relationship. This fabric is periodically displaced by feed dog 603 driven by the feed adjusting mechanism 132 which in addition to the mentioned reciprocating feed motion is provided, in a known way, with a perpendicular alternating movement, being really driven by main shaft 104.

Initially describing the embodiment of FIGS. 5 and 9, a ring 207 is fastened to main shaft 104 carrying (as it will be better described hereinafter) position indicator movable elements, such as permanent magnets 208, 209 and 210, in front of which three fixed sensor means, such as Hall effect sensors, 211, 212 and 213 are placed. In the area of standard 114, over plate 303, a panel 214 is provided as an interface between the operator and the sewing machine, and comprising a keyboard 215 and a segment display 216, for instance of the type described in the aforementioned commonly assigned copending U.S. patent applications. With reference to FIGS. 5, 8 and 9, ring 207 has a first portion 310, of circular section, and a radially extending second portion 311. Magnet 208 is inserted on ring 207 at a position close to the upper area of portion 311 and preferably formed, in this embodiment, by a permanent magnet cylinder placed with the axis parallel to the axis of ring 207. The two other position indicator elements, or magnets 209 and 210, which are similar to element 208, are preferably arranged, in this embodiment, in the first portion 310, parallel to the axis of ring 207, and have an average position substantially perpendicular relative to the position of element 208 and are angularly spaced apart so as to define an average angular sector of about 50° (FIG. 9). The three magnets 208, 209 and 210 have one end 208*a*, 209*a*, 210*a* projecting outwardly from ring 207 (FIG. 8) toward the three fixed sensors 211, 212 and 213, which are preferably magnistors of the known Hall effect type. These sensors 211, 212 and 213 are preferably arranged extending downwardly toward shaft 104 from the base 314 of a printed circuit plate 313, which may contain the magnistors and associated signal input circuitry for providing the position sensing signals to the control circuit of the sewing machine 100. The plate 313 may be of rectangular shape, with a plurality of connector wires 315 extending from base 314 to another connector 316, fixed in the lower portion of the main printed circuit plate 317, carrying the various components of the control circuit of the sewing machine 100 as described in the aforementioned copeding U.S. patent applications, so as to provide the sensing signals to plate 317. Such wires 315 are therefore the link between sensors 211, 212 and 213 and the rest of the control circuit as it will be more clearly shown with reference to FIGS. 2 and 3. More particularly, sensor means 211 and 213 are arranged according to the points of a circumference having the center on the axis of shaft 104, of radius equivalent to the distance of element 208 from this axis, and are angularly spaced at about 175° (FIG. 5), because at different times, as it will be described hereinafter, sensors 211 and 213 are separately actuated by the same element 208. On the contrary, sensor means 212 is placed at such a distance from the axis of the shaft 104 equal to the distance of indicator elements or magnets 209 and 210, because it must be actuated only by magnets 209 and 210. The printed circuit plate 313 is fastened by means of two screws 318, to the lower area of a cup-shaped portion 319 having rectangular section, in the lower part of a level-shaped mounting 320 having its perimetral edge turned upwardly. The mounting 320 is plastic made and obtained by molding, and has a substantially rectangular shape, with a projecting portion 321, substantially in the area of portion 319, such as to define sideways two open spaces 322 and 323, wherein two wire connectors 324 and 325 for connecting plate 317 to the remainder of the sewing machine 100 circuitry and/or test circuitry can have their seat and are fixed in their lower part to printed circuit plate 317. This mounting 320 is fastened to plate 303 of sewing machine 100 by means of four screws 327.

Figure 6:
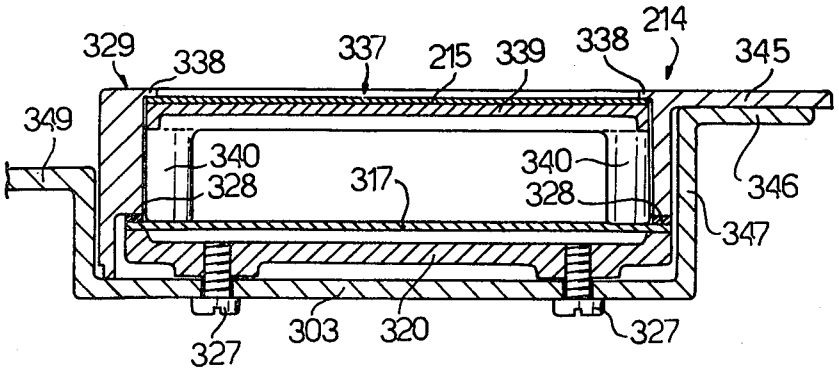
FIGS. 6, 7 and 8 are section views along lines VI—VI, VII—VII and VIII—VIII respectively of FIG. 5.
Figure 7:
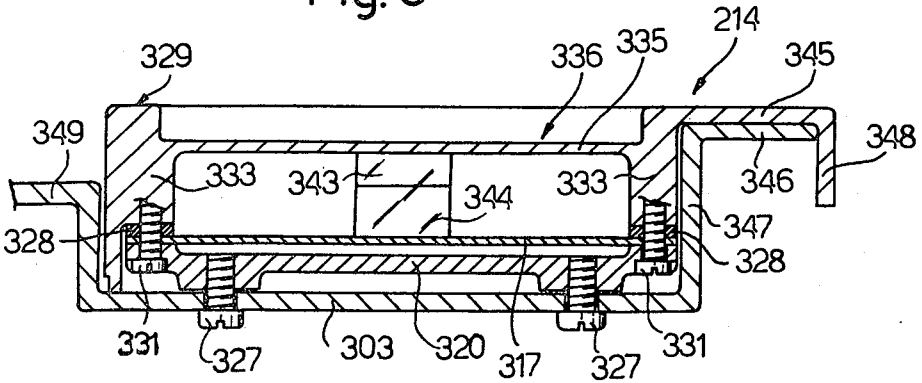
Figure 4:
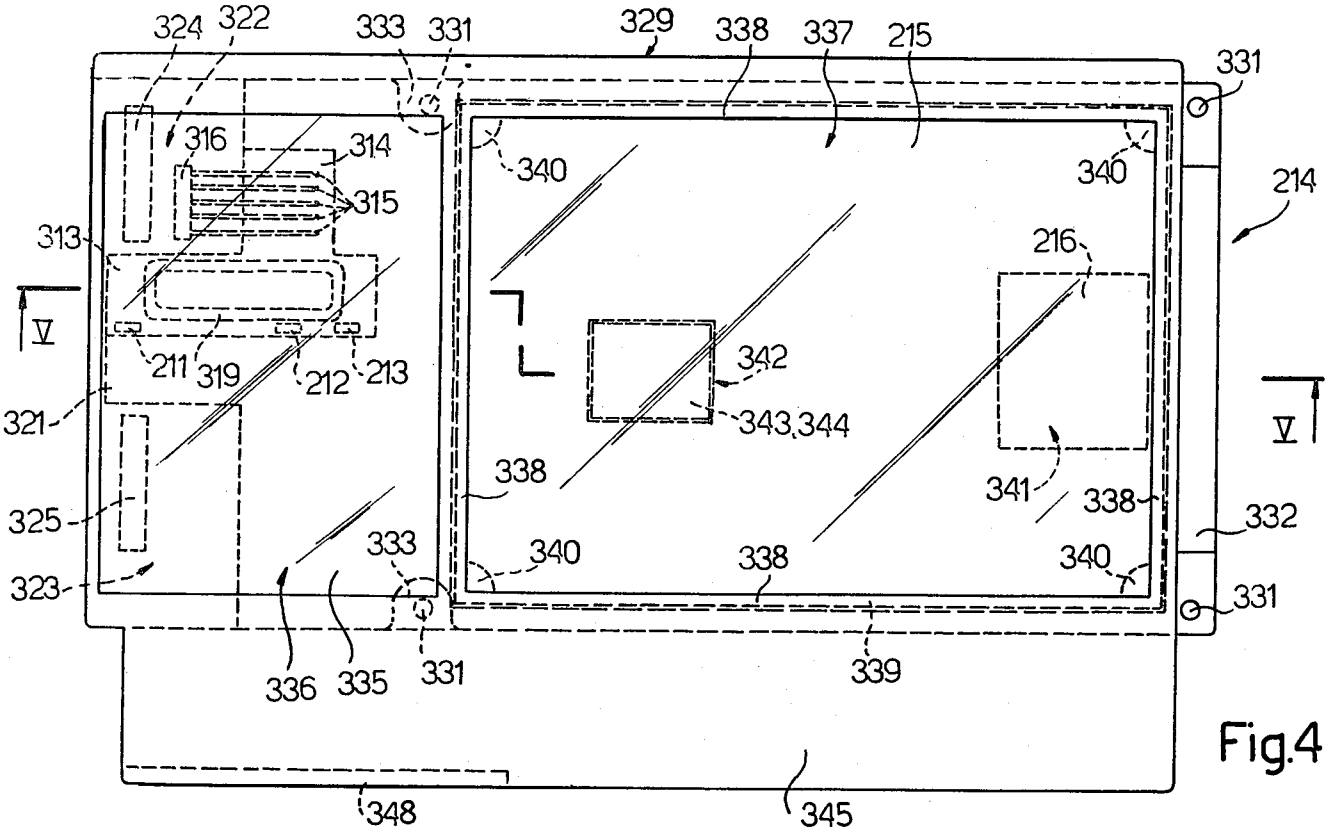
FIG. 4 is a front view showing a keyboard housing of the sewing machine of FIG. 1 with the keys and display omitted for sake of clarity.

Rectangularly shaped printed circuit plate 317 rests on the upper edge of the mounting 320, and may include a perimetral resilient element or seal 328, interposed on the perimetral edge of the plate 317 between plate 317 and the perimetral lower edge of a body 329. The perimetral element 328 compensates for any differences between mounting 320 and body 329 which are preferably shaped so as to be complementary to each other and are connected to each other by means of four screws 331, so so as to lock plate 317 in place. Two of the screws 331 penetrate a countersunk upper edge 332 of body 329 and the remaining ones penetrate in the relative column 333 projecting downward from body 329, a little over the half of the same body 329. The body 329, also conveniently made of plastic material, by molding, has a substantially rectangular shape and has, from the area of column 333 as far as the lower edge, a level wall 335, hollowed in such a way as to obtain a rectangular spaced 336. On the contrary, body 329, before columns 333, as far as the upper edge 332, has a rectangular opening 337 delimited by a perimetral edge 338 resting on the edge of keyboard 215, such as the keyboard described in the aforementioned copending U.S. patent applications, which is urged against a rectangular frame 339. Frame 339 is formed by an upper plane with four legs 340 which extend from the four corners thereof resting on the main printed circuit plate 317 (FIG. 6). In the upper portion of frame 339 a first opening 341 is provided for the keyboard display 216, and a second opening 342 for the passage of a wire connector 343 connected to keyboard 215 and engaged with a corresponding wire connector 344 connected to the main plate 317. Body 329 therefore has sideways a level wall 345 resting on a corresponding level wall 346 at the end of a vertical portion 347 of plate 303. The level wall 345, little over the half of body 329, at its outer edge bends orthogonally downward with a portion 348 (FIG. 7).

Plate 303 around body 329 has therefore, at heights lower than the height of same body 329, at one side, a plane 349, and at the other side close to the ending portion of body 329, a plane 350.

Figure 2:
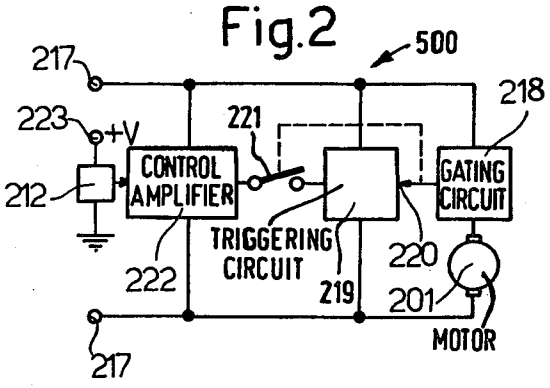
FIG. 2 is a block diagram of a conventional speed control circuit for the sewing machine of FIG. 1.
Figure 3:
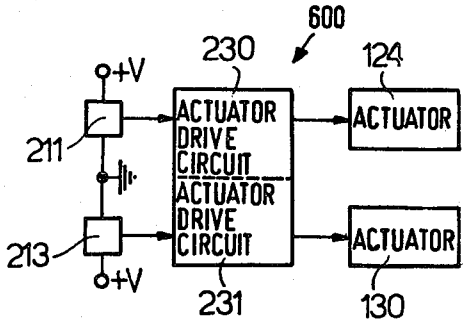
FIG. 3 is a block diagram of a conventional drive circuit for the actuators of the sewing machine of FIG. 1.

With reference to FIGS. 2 and 3, block diagrams of the conventional speed control 500 and drive 600 circuits employed in sewing machine 100 are shown. For example, speed control circuit 500 may functionally be of the type described in U.S. Pat. No. 3,518,520, with respect to speed control circuit 500 (FIG. 2), main motor 201 is fed by two AC connecting terminals 217, via a gating circuit 218 which is triggered by triggering circuit 219, connected between terminals 217, and from which a variable triggering voltage is provided, according to the position of a potentiometer 220 directly operated by a control (for instance a push-button or treadle control) of an operator. Such a potentiometer 220 is moreover mechanically connected to a switch 221 connecting a control amplifier 222 to triggering circuit 219. The control amplifier 222 is also connected between terminals 217 and receives the output of fixed sensor element 212, connected between a feed terminal 223 of positive voltage +V (i.e. 5 V) and ground. The known working of the speed control circuit 500 of FIG. 2 is as follows. When the operator progressively actuates the pushbutton or the treadle controlling the speed of motor 201, switch 221 opens and by progressively varying the position of potentiometer 220, a longer conduction interval is determined for gating circuit 218. When the operator wishes to stop the sewing machine, by releasing the control pushbutton or treadle, switch 221 closes and, upon the energizing of sensor 212 by means of its corresponding position indicating element (in this case permanent magnets 209 and 210), provides a signal to control amplifier 222, which, in turn, provides a signal triggering circuit 219 causing the de-energizing or opening of gating circuit 218, therefore stopping motor 201. Sensor 212 is therefore energized for such a time sufficient to allow main shaft 104 to stop in spite of its inertia effect. According to the improvement of the present invention in the above embodiment, this is obtained in a very simple way by means of the two permanent magnets 209 and 210 which covering an arc of approximately 50°, alternatively keep sensor 212 activated and for this reason, in such an arc of rotation, shaft 104 can stop. Such is the relative angular arrangement between shaft 104, permanent magnets 209 and 210 and sensor element 212, that shaft 104 stops in such a position that the needle 108 is raised from the fabric and is substantially in its upper position.

As shown in FIG. 3, actuators 124 and 130 receive a position control signal from their respective drive circuits 230 and 231, which may be conventional or of the type described in the aforementioned commonly owned U.S. patent applications. The provision of these signals is respectively determined by the timing control signals from sensor elements 211 and 213, which are similar to sensor 212, and are connected between a feed terminal +V and ground. More particularly, sensor element 211 sends timing control signal for beginning movement of actuator 124 substantially as soon as needle 108 is out of fabric, and sensor element 213 provides a timing control signal for beginning movement of actuator 130 substantially as soon as the point of needle 108 has penetrated the fabric. According to the improvement of the present invention in the above embodiment, sensor elements 211 and 213 are activated by the same magnet 208, with an angular interval of about 175°, corresponding to the angular rotation of shaft 104 defining these two positions for needle 108 which initiate the movement for the actuator 124 and for the actuator 130, respectively. The main components of actuator drive circuits 230 and 231, and also of circuits 222 and 219 are preferably arranged on the main plate 317, with connector 324 being used for the connection of this circuitry with other components, such as actuators 124 and 130. As previously mentioned, connector 325 is a supplemental connector, also utilizable for other auxiliary functions, such as test circuitry, but may be omitted if desired. With the improvement of the present invention in the above embodiment, the device generating synchronizing signals is therefore obtained in a rather simple and cheap way, and of reliable working, because only one permanent magnet 208 is used to activate two sensor elements 211 and 213, conveniently positioned, and moreover in a very simple way, by means of two permanent magnets 209 and 210 arranged on disc 207, activation of a single sensor element 212 is obtained for an angular interval sufficient to allow stopping of main shaft 104 in the desired angular position. The same constructive embodiment of panel 214 has several advantages, because it allows an easy assembling and a quick accessibility to various components and to plate 317. In addition, if a seal or resilient element 328 is employed, greater tolerances may be permitted in the construction of the structural elements. Moreover, the presence of frame 339, provides a safe resting place or support for the keyboard 215.

Figure 11:
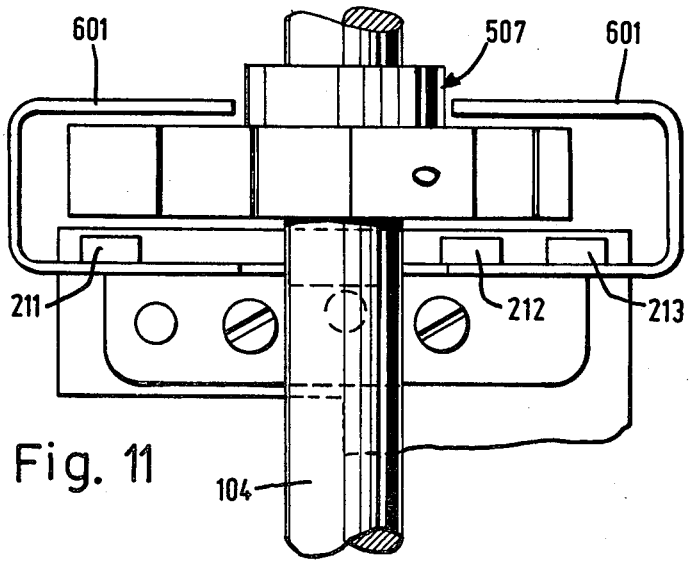
FIG. 11 is a fragmentary enlarged view of the presently preferred magnet holder and sensor arrangement portion of the present invention.
Figure 10:
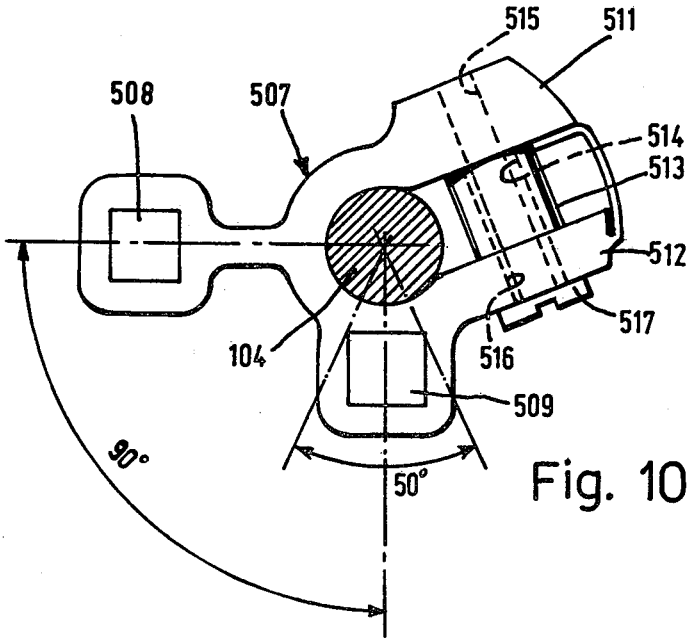
FIG. 10 is a front view, similar to FIG. 9, of the presently preferred magnet holder element portion of the device generating synchronizing signals comprising the improvement according to the present invention

Referring now to FIGS. 10 and 11, the presently preferred embodiment of the improvement of the present invention is shown. FIG. 10 illustrates the presently preferred magnet holder element portion 507 which preferably only includes two permanent magnets 508 and 509 in place of the three magnets 208, 209 and 210 of the embodiment of FIG. 9. In addition, magnets 508 and 509 are preferably substantially flush in holder 507 (FIG. 11) as opposed to extending outwardly as in the embodiment of FIG. 9. Furthermore, magnets 508 and 509 are rectangularly shaped as opposed to the cylindrical shape employed for magnets 208, 209, 210.

As shown and preferred in FIG. 10, magnet 509, which is associated with sensor 212, replaces magnets 209 and 210 and is of sufficient extent so as to encompass the previously described arc of approximately 50° required for the stopping of motor 201.

Magnet 508 replaces magnet 208 and functions in the same manner. The same 90° angular separation employed for magnet 208 and magnet pair 209–210 on FIG. 9 is employed in the embodiment of FIG. 10. In addition to only employing two magnets 508, 509 in place of three magnets 208, 209, 210, the presently preferred embodiment of FIG. 10–11 also preferably includes a soft iron loop 601 surrounding the magnets 508, 509 and magnistors 211, 212, 213 so as to close the magnetic path and increase the associated flux density and minimize losses. This arrangement is believed to enhance the operation of the sensing circuitry.

The magnet holder 507 is preferably made of plastic and has a presently preferred configuration which facilitates mounting of the holder 507 on shaft 104. Thus, holder 507 has a bifurcated portion 511–512 which, due to the resiliency of the plastic, may be spread apart to snap onto shaft 104. Thereafter a collar portion 513, which contains an internal aperture 514, is inserted between members 511 and 512 with aperture 514 aligned with corresponding apertures 515 and 516 in members 511 and 512. A bolt or screw 517 is then threaded through the aligned apertures 516–514–515 to clamp holder 507 to shaft 104.

By employing the linearly aligned spaced magnistors 211, 212 and 213 of the present invention in conjunction with the preferred magnet holder 207 or 507 which is readily mountable on shaft 104 so as to cause the appropriate magnets 208–209–210 or 508–509, respectively, to interact with these mounted magnistors 211, 212, 213 during rotation of shaft 104, assembly and alignment of the synchronizing elements of the sewing machine 100 is greatly facilitated. This advantage is apart from the other numerous advantages mentioned above.

It is at last evident that in the kind of embodiments described and shown of the improvement according to the present invention changes can be made which remain within the limits of the same invention. For example the relative arrangement among various sensor elements 211, 212 and 213 and among permanent magnets 208, 209 and 210 can be varied; and similarly illustrative block diagrams of FIGS. 2 and 3 can be varied.

What is claimed is:

1. In a sewing machine having a needle bar means capable of transverse oscillation thereof relative to the direction of fabric feed in said sewing machine, feed means for adjusting the length and direction of said fabric feed, first actuator means for adjusting the transverse position of said needle bar means in response to control signals provided thereto, second actuator means for adjusting the positional displacement of said feed means in response to control signals provided thereto, rotatable main shaft means operatively connected to said needle bar means for enabling said transverse oscillation thereof, and main drive motor means drivingly connected to said main shaft means and said feed means for enabling sewing by said sewing machine; the improvement comprising means for generating synchronizing timing control signals to at least said first and second actuator means, said generating means comprising a first magnetic sensor means associated with said first actuator means and a second magnetic sensor means associated with said second actuator means and spaced from said first sensor means, and a first common magnet means disposed for synchronous rotation with said main shaft means for successively interacting with said first and second magnetic sensor means during rotation of said main shaft means for successively providing said synchronizing timing control signals.

2. An improved sewing machine in accordance with claim 1 wherein said generating means further comprises a second magnet means disposed for synchronous rotation with said main shaft means and a third magnetic sensor means associated with said main drive motor means for providing a stop control synchronizing signal thereto, said second magnetic means being disposed for interacting with said third magnetic sensor means for a sufficient angular interval of rotation of said main shaft means to enable stopping of said main shaft means in a predetermined arc of rotation of said main shaft means.

3. An improved sewing machine in accordance with claim 2 wherein said first and second magnet means are mounted on said main shaft means for rotation therewith.

4. An improved sewing machine in accordance with claim 3 wherein said first and second magnet means are mounted on said main shaft means in a common holder therefor.

5. An improved sewing machine in accordance with claim 4 wherein said first and second magnet means comprise permanent magnets.

6. An improved sewing machine in accordance with claim 5 wherein said second magnet means comprises a pair of magnets angularly spaced apart from each other in the direction of rotation of said main shaft means by substantially said predetermined arc of rotation.

7. An improved sewing machine in accordance with claim 6 wherein said predetermined arc of rotation is substantially about 50 degrees.

8. An improved sewing machine in accordance with claim 7 wherein said first and second magnetic sensor means are linearly spaced apart from each other in a common plane, with said linear spacing being defined by a predetermined angular rotation of said first common magnet means sufficient for providing a predetermined interval between said successive interaction for successively providing said synchronizing timing control signals.

9. An improved sewing machine in accordance with claim 8 wherein said angular rotation is substantially about 175 degrees.

10. An improved sewing machine in accordance with claim 9 wherein said third magnetic sensor means is linearly spaced apart from said first and second magnetic sensor means in said common plane.

11. An improved sewing machine in accordance with claim 10 wherein said first, second and third magnetic sensor means comprise Hall-effect type sensors.

12. An improved sewing machine in accordance with claim 11 wherein said first magnet means is mounted on said main shaft means for rotation therewith.

13. An improved sewing machine in accordance with claim 12 wherein said first magnet means comprises a permanent magnet.

14. An improved sewing machine in accordance with claim 13 wherein said first and second magnetic sensor means comprise Hall-effect type sensors.

15. An improved sewing machine in accordance with claim 1 wherein said first and second magnetic sensor means are linearly spaced apart from each other in a common plane, with said linear spacing being defined by a predetermined angular rotation of said first common magnet means sufficient for providing a predetermined interval between said successive interaction for successively providing said synchronizing timing control signals.

16. An improved sewing machine in accordance with claim 15 wherein said angular rotatin is substantially about 175 degrees.

17. An improved sewing machine in accordance with claim 15 wherein said first magnet means comprises a permanent magnet.

18. An improved sewing machine in accordance with claim 17 wherein said first and second magnetic sensor means comprise Hall-effect type sensors.

19. An improved sewing machine in accordance with claim 2 wherein said second magnet means comprises a pair of magnets angularly spaced apart from each other in the direction of rotation of said main shaft means by substantially said predetermined arc of rotation.

20. An improved sewing machine in accordance with claim 19 wherein said predetermined arc of rotation is substantially about 50 degrees.

21. An improved sewing machine in accordance with claim 2 wherein said first and second magnetic sensor means are linearly spaced apart from each other in a common plane, with said linear spacing being defined by a predetermined angular rotation of said first common magnet means sufficient for providing a predetermined interval between said successive interaction for successively providing said synchronizing timing control signals.

22. An improved sewing machine in accordance with claim 21 wherein said angular rotation is substantially about 175 degrees.

23. An improved sewing machine in accordance with claim 21 wherein said third magnetic sensor means is linearly spaced apart from said first and second magnetic sensor means in said common plane.

24. An improved sewing machine in accordance with claim 23 wherein said first and second magnet means comprise permanent magnets.

25. An improved sewing machine in accordance with claim 24 wherein said first, second and third magnetic sensor means comprise Hall-effect type sensors.

26. An improved sewing machine in accordance with claim 1 wherein said first common magnet means successively interacts with said first and second magnetic sensor means at the beginning of upper exit of the needle from the fabric and the beginning of lower entrance of the needle into the fabric, respectively, during the rotation of said main shaft means.

27. An improved sewing machine in accordance with claim 2 wherein said second magnet means interacts with said third magnetic sensor means substantially in the maximum upper exit condition of the needle from the fabric during the rotation of said main shaft means.

28. An improved sewing machine in accordance with claim 23 wherein said common plane is defined by a printed circuit board comprising associated circuitry for said sewing machine.

29. An improved sewing machine in accordance with claim 28 wherein said sewing machine further comprises a keyboard, said keyboard and said printed circuit board being mountable in said sewing machine in a common housing therefor.

30. An improved sewing machine in accordance with claim 4 wherein said common holder comprises a resilient member having a bifurcated portion for facilitating mounting thereof on said main shaft means.

31. An improved sewing machine in accordance with claim 1 wherein said generating means further comprises a soft iron loop substantially surrounding the area of interaction of said first magnet means and said first and second magnetic sensor means for facilitating closure of the magnetic path formed in said area and increasing the associated flux density within said area.

32. An improved sewing machine in accordance with claim 2 wherein said generating means further comprises a soft iron loop substantially surrounding the area of interaction of said first magnet means and said first and second magnetic sensor means and said second magnet means and said third magnetic sensor means for facilitating closure of the magnetic path formed in said area and increasing the associated flux density within said area.

33. An improved sewing machine in accordance with claim 3 wherein said first and second magnet means are angularly spaced apart by substantially 90 degrees in the direction of rotation of said main shaft means.

34. An improved sewing machine in accordance with claim 33 wherein said first and second magnet means are mounted on said main shaft means in a common holder therefor.

35. An improved sewing machine in accordance with claim 33 wherein said second magnet means comprises a pair of magnets angularly spaced apart from each other in the direction of rotation of said main shaft means by substantially said predetermined arc of rotation, said first magnet means being angularly spaced apart by substantially 90 degrees from a point intermediate the angular spacing between said pair of magnets comprising said second magnet means.

36. An improved sewing machine in accordance with claim 2 wherein said second magnet means comprises a single magnet having a sufficient angular extent between the extremities thereof defined by said predetermined arc of rotation.

37. An improved sewing machine in accordance with claim 1 wherein said first and second magnetic sensor means comprise magnistors.

38. An improved sewing machine in accordance with claim 37 wherein said third magnetic sensor means comprises a magnistor.

39. In a sewing machine having a needle bar means capable of transverse oscillation thereof relative to the direction of fabric feed in said sewing machine, feed means for adjusting the length and direction of said fabric feed, first actuator means for adjusting the transverse position of said needle bar means in response to control signals provided thereto, second actuator means for adjusting the positional displacement of said feed means in response to control signals provided thereto, rotatable main shaft means operatively connected to said needle bar means for enabling said transverse oscillation thereof, and main drive motor means drivingly connected to said main shaft means and said feed means for enabling sewing by said sewing machine; the improvement comprising means for generating a stop control synchronizing signal to said main drive motor means, said generating means comprising a first magnetic sensor means associated with said main drive motor means for providing said stop control synchronizing signal thereto, and a first magnet means disposed for synchronous rotation with said main shaft means for interacting with said first magnetic sensor means for a sufficient angular interval of rotation to enable stopping of said main shaft means in a predetermined arc of rotation of said main shaft means, said first magnet means comprising a pair of magnets angularly spaced apart from each other in the direction of rotation of said main shaft means by substantially said predetermined arc of rotation.

40. An improved sewing machine in accordance with claim 39 wherein said predetermined arc of rotation is substantially about 50 degrees.

41. In a sewing machine having a needle bar means capable of transverse oscillation thereof relative to the direction of fabric feed in said sewing machine, feed means for adjusting the length and direction of said fabric feed, first actuator means for adjusting the transverse position of said needle bar means in response to control signals provided thereto, second actuator means for adjusting the positional displacement of said feed means in response to control signals provided thereto, rotatable main shaft means operatively connected to said needle bar means for enabling said transverse oscillation thereof, and main drive motor means drivingly connected to said main shaft means and said feed means for enabling sewing by said sewing machine; the improvement comprising means for generating a stop control synchronizing signal to said main drive motor means, said generating means comprising a first magnetic sensor means associated with said main drive motor means for providing said stop control synchronizing signal thereto, and a first magnet means disposed for synchronous rotation with said main shaft means for interacting with said first magnetic sensor means for a sufficient angular interval of rotation to enable stopping of said main shaft means in a predetermined arc of rotation of said main shaft means, wherein said generating means further comprises a soft iron loop substantially surrounding the area of interaction of said first magnet means and said first magnetic sensor means for facilitating closure of the magnetic path formed in said area and increasing the associated flux density within said area.

* * * * *